United States Patent [19]

Nürk

[11] Patent Number: 4,516,738

[45] Date of Patent: May 14, 1985

[54] THREAD-BRAKING DEVICE FOR A TEXTILE MACHINE

[75] Inventor: Siegfried Nürk, Albstadt, Fed. Rep. of Germany

[73] Assignee: Sipra, Patententwicklungs-und Beteiligungsgegesellschaft gmbH, Stuttgart, Fed. Rep. of Germany

[21] Appl. No.: 543,998

[22] Filed: Oct. 20, 1983

[30] Foreign Application Priority Data

Oct. 26, 1982 [DE] Fed. Rep. of Germany ..... 3239495

[51] Int. Cl.[3] ..... B65H 59/22

[52] U.S. Cl. ..... 242/152.1

[58] Field of Search ..... 242/152.1, 149, 150 M, 242/155 M, 147 R, 147 M, 129.8; 226/195

[56] References Cited

U.S. PATENT DOCUMENTS 2,677,511 5/1954 Bley ..... 242/152.1 X 3,053,474 9/1962 Luntz et al. ..... 242/150 M 4,123,014 10/1978 McCullough ..... 242/152.1

FOREIGN PATENT DOCUMENTS 1061239 7/1959 Fed. Rep. of Germany ... 242/152.1

*Primary Examiner*—Stanley N. Gilreath

*Attorney, Agent, or Firm*—Michael J. Striker

[57] ABSTRACT

A thread-braking arrangment for a textile machine comprises an outer housing, in which a magnetic member is provided, supported by a supporting element. A ball seat-forming element of non-magnetizable material is mounted on the supporting element. A ball of a magnetizable material is arranged against the ball seat of that element. A magnetic force generated by the magnetic member draws the ball towards the ball-seat. A thread is passed between the ball and the ball seat. The magnetic member, the supporting element and the ball seat-forming element are enclosed in a casing and form a brake unit releasably insertable into the outer housing by means of a spring ring.

7 Claims, 3 Drawing Figures

THREAD-BRAKING DEVICE FOR A TEXTILE MACHINE

BACKGROUND OF THE INVENTION

The present invention relates to thread-braking devices employed in commonly known textile machines. More particularly, the invention pertains to a textile thread-braking device in which a thread is drawn between a ball and a ball seat.

Thread-braking devices, which employ a ball-like structure have been known in the art. These known arrangements as compared to also known plate-like brakes, have the advantage that a self-cleaning of the device from a fiber fuzz can be obtained because of the continuously movable ball.

There are also known ball-containing braking arrangements, in which a braking force acting on the textile thread can be adjusted. In these arrangements the ball can be loaded with a number of additional balls, or the ball-type brake can be provided with a number of balls with the corresponding ball seats with which the balls cooperate to pass the thread therebetween, and the thread can be selectively guided through one or more braking positions arranged between the respective balls and ball seats.

It has been also known to adjust the braking force of the thread-braking ball-type device in a stepwise manner so that the ball is loaded by a compression spring of an adjustable tension. In such a thread-braking device, the free movement play of the ball is affected by the spring, which can lead to an undesired reverse movement of the passing thread. A fiber dust deposited on the surfaces of the thread-braking device can also be accumulated on the ball loading spring.

SUMMARY OF THE INVENTION

It is an object of the present invention to provide an improved thread-braking device for a textile machine.

It is a further object of the invention to provide a thread-braking device which has a self-cleaning ability and in which the braking force is defined not only by the weight of the ball applied against the ball seat.

It is still another object of the present invention to provide a thread-braking device which ensures a continuous adjustment of the braking force, without however requiring additional mechanical means which are subject to contamination.

These and other objects of the invention are attained by a thread-braking device for a textile machine, comprising an outer housing of a nonmagnetic material and having an extension with a through passage for passing, a textile thread therethrough, said outer housing being axially symmetrical and hollow; and a preassembled axially symmetrical thread-braking unit releasably-insertable in said outer housing and including a magnetic member, a ball-seat forming element of nonmagnetizable material and a ball of a magnetizable material mounted against a ball-seat of said element to pass the thread therebetween, said magnetic member exerting a magnetic force acting on said ball to move said ball towards said ball seat; and means for releasably locking said brake unit in said outer housing, said means including a spring ring.

The magnetic member which may be either magnetic or magnetizable may be cylindrical and surround the annular ball seat-forming element.

According to the present invention the ball formed of magnetizable material is, due to the magnetic force applied over the entire periphery of the ball seat, moved towards the ball seat-forming element of nonmetallic and nonmagnetizable material. The ball-type braking device is so constructed that the ball is positioned concentrically to and coaxially with the ball seat-forming element and is at the distance from the ring-shaped magnetic member or a pole shoe which generate a magnetic field.

According to a further concept of the invention said brake unit may include a cup-shaped casing of a magnetizable material surrounding said magnetic member.

The cup-shaped casing may have a bottom wall formed with an opening concentric with said casing.

The device may further include a cylindrical supporting member for supporting said magnetic member in said casing.

The supporting member may be formed with a central opening into which said ball seat-forming element extends.

The magnetic member may include an electromagnetic spool, said bottom wall concentrically surrounding said ring-shaped ball seat-forming element and forming a pole shoe for said electromagnetic spool.

The supporting member is a hollow cylinder which is displaceable along the axis thereof relative to said casing.

The ring-shaped magnetic member may be a permanent magnet. In this case the device may further include an insulating sleeve disposed between said permanent magnet and said casing, said insulating sleeve being supported on said bottom wall of said casing.

The ring-shaped magnetic member may include an electromagnetic spool, and an additional ring-shaped permanent magnet may be provided, which is concentrically mounted between said spool and said supporting member. In this case a further ring may be mounted on the casing to enclose said electromagnetic spool and said permanent magnet in said casing and form a pole shoe for said electromagnetic spool.

The device may further include a ceramic element inserted into said central opening of the supporting member at the end thereof opposite to said ball seat-forming element.

In view of the above it should be understood that the magnetic field in the brake unit can be exerted either by a current-carrying spool, or by a permanent magnet a combined magnetic field may be generated by the permanent magnet and electromagnetic spool. In all the cases, however, the braking force of the braking device is adjustable. In the case of the permanent magnetic field, the adjustment of the braking force is obtained by a relative adjustment of the ball seat in the axial direction of the ball seat forming element in respect to the magnetic member generating the magnetic field. In the event, when an electromagnetic spool is employed, the adjustment of the braking force is carried out by a regulation of the energizing current supplied to the wire spool. The advantage of the proposed device is that a number of ball-type brakes with a simultaneously and continuously adjustable braking force may be employed.

Research has shown that with the ball-type braking devices, a thread can run in both opposite directions and it is particularly advantageous to use a ball-seat forming element of nonmagnetizable material, particularly ceramic material so that a rotation of this element as well as a free play for a ball arranged against the ball seat are satisfactory dispite of the loading by the magnetic field. In the device of the invention a lateral displacement of the ball from the ball seat due to the magnetic force does not occur.

The ball-type braking device of the invention is so constructed that the magnetic spool and the permanent magnet may be of the same polarity or of the opposite polarity. A selection of the mutual polarity of the magnetic members in the device allows for a great variety of different constructions which may be proposed depending on other various factors, for example the direction of running of the thread in the textile machine.

Due to the fact that the brake device of the invention is constructed of axially symmetrical components, the manufacturing of the device may be rather inexpensive. The preassembled brake unit including a magnetic member with the pole shoe and with the ball seat-forming element can be easily inserted into a nonmetallic protective outer housing and releasably locked therein by the spring ring. The loss of the ball is avoided due to the provision of the ball-retaining pin extended into the device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
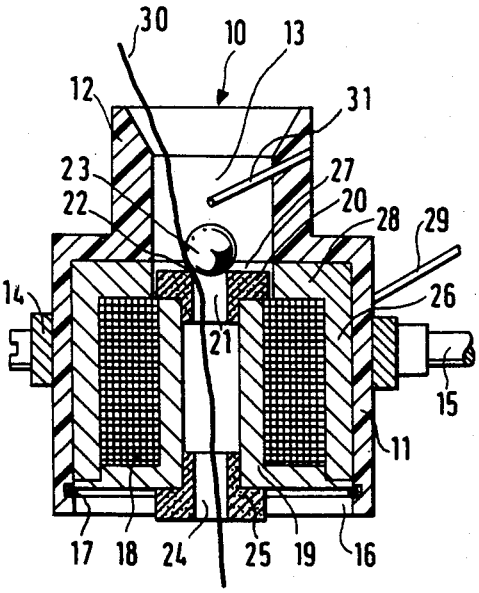
FIG. 1 is an axial section through a ball-type thread-braking arrangement of the first embodiment of the invention.

Referring now to the drawings, and firstly to FIG. 1, it will be seen that a ball-type thread brake is designated by a reference numeral 10. The brake 10 comprises a cylindrical housing 11 with an extension 12 of a reduced diameter, projecting in the upward direction. This extension 12 encloses a passage 13 which may be a thread inlet passage or a thread outlet passage depending on the direction in which the thread would be drawn off.

The housing 11 is formed of a synthetic plastic material and is embraced by a clamping ring 14, which via a supporting rod 15 is connected to a textile machine not illustrated herein. A suitable thread-braking arrangement as a preassembled unit is inserted into housing 11 through an opening 16 at the bottom thereof. This preassembled unit which will be described in detail hereinafter, is releasably locked after the insertion, in the housing 11 by means of a spring ring 17 located in a groove provided in the inner wall of the housing 11.

This preassembled brake unit or insert includes a coil of wire 18 which is mounted on or wound around a spool sleeve 19. A ring-like member 20 formed of ceramic material is partially inserted into the spool sleeve 19 at the upper end thereof. Ring-like member 20 has a central through opening 21, the upper rim of which forms a ball seat 22 for a thread-braking ball 23 of a magnetizable material. Spool sleeve 19 is formed of iron and receives at the lower end thereof an annular member 25 of ceramic material; annular member 25 has a thread-passage opening 24 which serves as a thread eyelet.

Over the wire coil 18 is pushed a cup-shaped element 26 of iron, the bottom wall of which forms a pole shoe 28. The latter is provided with an opening 27 in which the ceramic member 20 forming the ball seat 22 is received. Pole shoe 28 concentrically surrounds the whole periphery of the ball seat 22.

The coil of wire 18 is connected by means of a connecting lead 29 to a non-illustrated suitable conventional control device for adjusting current intensity on a non-shown and known voltage source. The magnetic field lines of the magnetic field generated by the energized coil of wire 18 flow from the ring-like pole shoe 28 via the ball 23 formed of iron, then via the spool sleeve 19 and back to the coil of wire and, depending on the intensity of the generated magnetic field, move the ball 23 toward the ball seat 22. The retarded thread 30 running between ball 23 and ball seat 22 will be braked depending on the intensity of the exerted magnetic force of the generated magnetic field at this point. Thread 30 can be drawn between the ball and the ball seat either from above downwardly or from below in the upward direction. To prevent the ball from moving far away from seat 22 when the thread is pulled in the upward direction and when the coil of wire 18 is deenergized, a ball-retaining pin 31 is provided, which is fixed in the extension 12 of the housing 11 and inclined to the central axis of the housing. Ball-retaining pin 31 extends into the thread passage 13 and terminates with its end at the distance from ball 23.

Figure 2:
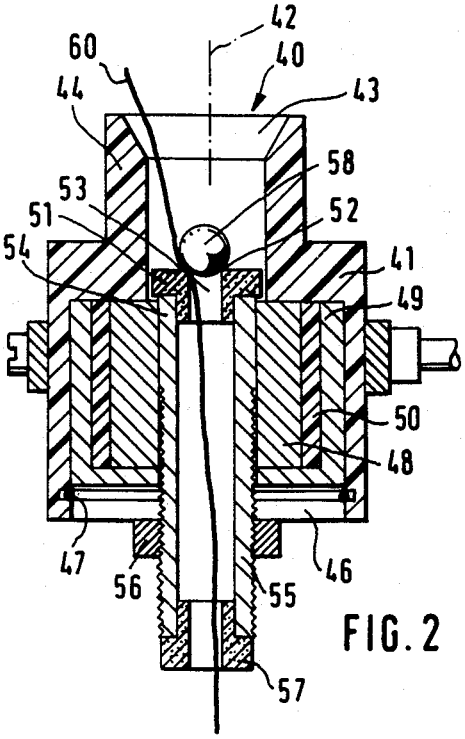
FIG. 2 is an axial section through the second embodiment of the thread-braking arrangement.

FIG. 2 illustrates a central sectional view of the modified embodiment of the thread-braking arrangement. The thread brake in this embodiment is denoted by a reference character 40 and is axially symmetrical. The thread-braking device includes a cylindrical housing 41 with an extension 44 of a reduced diameter. A preassembled unit or insert, similarly to the embodiment of FIG. 1, is inserted into the housing 41 via its bottom opening 46 and is releasably locked therein by means of a spring ring 47.

The preassembled insert includes a tubular permanent magnet 48 which is located in a cup-shaped magnet support 49. The permanent magnet 48 is concentrically surrounded by an insulating sleeve 50 which is inserted in the magnet support 49. A ball seat 52 is formed at the edge of a central thread-passing opening 53 formed in a ring-like member 51 which also serves as a thread eyelet. Member 51 is partially received in a central hole of an elongated sleeve 54 formed of a non-magnetizable material, which in turn extends through the central opening of permanent magnet 48. Sleeve 54 is provided with an outer thread 55, whereas the bottom wall of magnet support 49 is provided with an inner thread; thereby sleeve 54 is adjustable in the longitudinal direction with respect to magnet support 49. Sleeve 54 can be locked in position by a counter nut 56. A ceramic annular element 57 is partially inserted into the central hole of sleeve 54. Ceramic element 57 with a central bore therein serves as a thread eyelet.

In the modified embodiment of FIG. 2, thread 60 can be drawn off in one or the opposite direction between ball 58 and ball seat 52. The magnetic field lines of the permanent magnet 48 flow via ball 58 and magnet support 49. Housing 41 is made out of synthetic plastic material. The extension 44 of housing 41 is formed with a thread-passing conical passage 43 which is made at the distance from ball seat 52 and forms a ball chute. The intensity of the magnetic force acting on the ball can be adjusted through the adjustment of the position of inner sleeve 54 in the longitudinal direction so that the path of the magnetic field lines flowing through the magnet support 49 and permanent magnet 48 via the ball 58 and back toward permanent magnet element 48 can be shortened or lengthened due to the adjustment of the inner sleeve 54 longitudinally.

Figure 3:
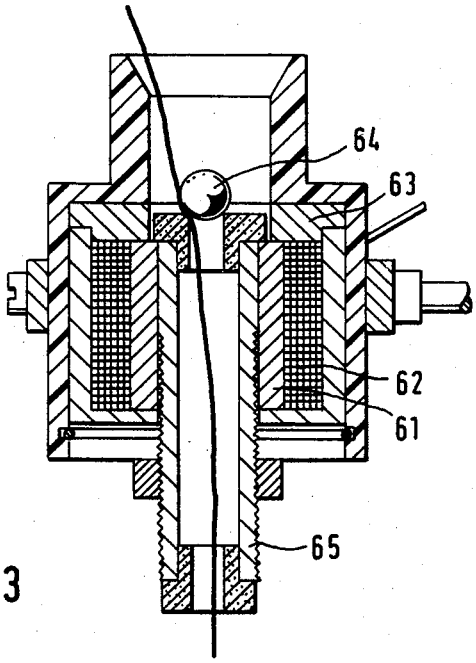
FIG. 3 is an axial section through the third embodiment of the thread-braking arrangement according to the invention.

FIG. 3 illustrates still another embodiment of the thread-braking arrangement for a textile machine, according to the invention. In the axial sectional view of FIG. 3, the elements similar to those shown in FIG. 2 are not explained in detail for the sake of simplicity. In the embodiment of FIG. 3, a permanent magnetic ring 61 concentrically surrounds the longitudinally displaceable inner sleeve 65. A magnetic spool 62 in turn concentrically surrounds permanent magnetic ring 61. Ring 61 and magnetic spool 62 both actuate the braking ball 64 via a common pole shoe 63. The magnetic spool 62 which can be selectively supplied by current flowing in one or in the opposite direction so that in one case magnetic field lines of the magnetic field exerted on spool 62 will flow in the same direction as magnetic field lines of the permanent magnetic ring 61 and in the other case the magnetic field lines of the magnetic field of spool 62 will flow opposite to the magnetic field lines of the permanent magnetic ring 61; in the first case the permanent magnetic force acting on the thread-braking ball 64 will be increased whereas in the second case it will be weakened. If the magnetic spool 62 is shut off the strength of the magnetic force exerted on the ball 64 from the permanent magnetic ring 61 can be adjusted due to the longitudinal displacement of the inner sleeve 65 similarly to that of the embodiment of FIG. 2, whereby the position of ball 64 relative to the ball seat and thus the braking force of ball 64 will be adjusted.

It will be understood that each of the elements described above, or two or more together, may also find a useful application in other types of thread-braking arrangements for textile machines differing from the types described above.

While the invention has been illustrated and described as embodied in a thread-braking device for a textile machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A thread-braking device for textile threads, comprising an axially symmetrical outer housing open at two ends thereof and having a through passage for passing a textile thread therethrough; and an axially symmetrical thread brake insert releasably insertable into said outer housing and including a cup-shaped casing of magnetizable material which is surrounded by said outer housing, a ball of magnetizable material, a ring-shaped ball seat-forming element of non-magnetizable material and forming a brake surface at which a thread is braked by said ball, said cup-shaped casing receiving said ball seat-forming element concentrically with the casing, and an electromagnetic spool concentrically positioned in said cup-shaped casing, said casing having means of magnetizable material forming a pole shoe for said spool, whereby a magnetic force is exerted on said ball which can be adjusted by adjusting a current applied to said electromagnetic spool.

2. The device as defined in claim 1, wherein said cup-shaped casing has a bottom wall which constitutes said means forming a pole shoe, said bottom wall having a central opening receiving said ball seat-forming element.

3. The device as defined in claim 1, wherein said ring-shaped ball seat-forming element is axially displaceable.

4. The device as defined in claim 3, and further including an inner sleeve concentrically positioned in said cup-shaped casing and connected to said insert by thread.

5. The device as defined in claim 1, further including a spring ring which secures said cup-shaped casing of said insert in said outer housing.

6. The device as defined in claim 4, wherein said means forming a pole shoe is a ring positioned on said cup-shaped casing.

7. The device as defined in claim 6, further including a ring-shaped permanent magnet which is positioned in said cup-shaped casing concentrically with said electromagnetic spool.

* * * * *